United States Patent [19]

Pai et al.

[11] Patent Number: 4,770,963

[45] Date of Patent: Sep. 13, 1988

[54] HUMIDITY INSENSITIVE PHOTORESPONSIVE IMAGING MEMBERS

[75] Inventors: Damodar M. Pai, Fairport; Richard L. Schank, Pittsford; Paul J. DeFeo, Ontario, all of N.Y.

[73] Assignee: Xerox Corporation, Stamford, Conn.

[21] Appl. No.: 8,978

[22] Filed: Jan. 30, 1987

[51] Int. Cl.[4] ..... G03G 5/082; G03G 5/14

[52] U.S. Cl. ..... 430/64; 430/66; 430/85; 430/95

[58] Field of Search ..... 430/58, 57, 66, 67, 430/65, 85, 95

[56] References Cited

U.S. PATENT DOCUMENTS

| | | | |
|---|---|---|---|
| 4,148,637 | 4/1979 | Kubota et al. | 96/1.5 N |
| 4,256,823 | 3/1981 | Takahashi et al. | 430/66 |
| 4,371,600 | 2/1983 | Schank et al. | 430/56 |
| 4,407,920 | 10/1983 | Lee et al. | 430/59 |
| 4,439,509 | 3/1984 | Schank | 430/132 |
| 4,471,042 | 9/1984 | Komatsu et al. | 430/64 |
| 4,529,679 | 7/1985 | Ogawa et al. | 430/84 |
| 4,536,459 | 8/1985 | Misumi et al. | 430/57 |
| 4,544,617 | 10/1985 | Mort et al. | 430/67 |

*Primary Examiner*—John L. Goodrow
*Attorney, Agent, or Firm*—E. O. Palazzo

[57] ABSTRACT

A photoresponsive imaging member comprised of a supporting substrate; a barrier layer of hydrogenated amorphous silicon with dopants therein; a photoconductive layer of hydrogenated amorphous silicon; a first overcoating layer of nonstoichiometric silicon nitride; and a second overcoating layer of a silicone-silica hybrid polymer.

40 Claims, 1 Drawing Sheet

HUMIDITY INSENSITIVE PHOTORESPONSIVE IMAGING MEMBERS

BACKGROUND OF THE INVENTION

This invention is generally directed to amorphous silicon imaging members, and more specifically the present invention is directed to layered photoresponsive imaging members containing therein hydrogenated amorphous silicon, and as overcoatings certain silane or silicone compositions. In one embodiment of the present invention, there is provided a layered photoresponsive imaging member comprised of a supporting substrate, a photoconductive layer of hydrogenated amorphous silicon, and an overcoating thereof of silicone-silica hybrid components. Moreover, the aforementioned hybrid overcoatings can be selected for a variety of photoconductive imaging members containing hydrogenated amorphous silicon inclusive of those illustrated in copending applications and U.S. patents described hereinafter. The aforementioned imaging members of the present invention can be incorporated into electrophotographic; and in particular xerographic imaging and printing systems wherein, for example, the latent electrostatic patterns which are formed can be developed into images of high quality and excellent resolution at substantially all humidity values inclusive of those situations wherein the relative humidity is greater than 70 percent. Many of the prior art photoresponsive imaging members containing hydrogenated amorphous silicon are sensitive to relative humidities, particularly in excess of 50 percent, thus the resolution image loss can be substantial, for example, at relative humidities of greater than 70 percent as illustrated hereinafter, the resolution loss is substantially greater than 90 percent rendering the resulting images unusable and unreadable. Accordingly, the photoresponsive imaging members of the present invention when incorporated into electrostatographic imaging systems are of substantial assistance in eliminating and/or preventing moisture sensitivity, which will cause undesirable fuzzy images to be formulated; and further results in image deletion.

Numerous photoconductive components are known inclusive of amorphous selenium, alloys of selenium such as selenium arsenic, and the like. Additionally, there can be selected as photoresponsive imaging members various organic photoconductive materials including, for example, complexes of trinitrofluorenone and polyvinylcarbazole. Further, organic photoresponsive devices with aryl amine hole transporting molecules, and photogenerating layers inclusive of trigonal selenium are illustrated in U.S. Pat. No. 4,265,990, the disclosure of which is totally incorporated herein by reference.

Also known are amorphous silicon photoconductors, reference for example U.S. Pat. Nos. 4,265,991 and 4,225,222. There is disclosed in the '991 patent an electrophotographic photosensitive member comprised of a substrate, and a photoconductive overlayer with a thickness of 5 to 80 microns of amorphous silicon containing 10 to 40 atomic percent of hydrogen. Additionally, this patent describes several processes for preparing amorphous silicon. In one process embodiment, there is prepared an electrophotographic photosensitive member by heating the member present in a chamber to a temperature of 50° C. to 350° C., introducing a gas with silicon and hydrogen atoms, providing an electrical discharge in the chamber by electric energy to ionize the gas, followed by depositing amorphous silicon on an electrophotographic substrate at a rate of 0.5 to 100 Angstroms per second by utilizing an electric discharge thereby resulting in an amorphous silicon photoconductive layer of a predetermined thickness. Although the amorphous silicon device described in this patent is photosensitive, after a minimum number of imaging cycles, less than about 1,000 for example, unacceptable low quality images of poor resolution with many deletions may result. With further cycling, that is subsequent to 1,000 imaging cycles and after 10,000 imaging cycles, the image quality may continue to deteriorate often until images are partially deleted.

Further, there is disclosed in the prior art amorphous silicon photoreceptor imaging members containing, for example, stoichiometric silicon nitride overcoatings; however, these members in some instances generate prints of low resolution as a result of the band bending phenomena. Additionally, with the aforementioned silicon nitride overcoatings, the resolution loss can in many instances be extreme thereby preventing, for example, any image formation whatsoever.

There are also illustrated in copending applications photoconductive imaging members comprised of amorphous silicon. Accordingly, for example, there is illustrated in copending application U.S. Ser. No. 695,990, entitled Electrophotographic Devices Containing Compensated Amorphous Silicon Compositions, the disclosure of which is totally incorporated herein by reference, an imaging member comprised of a supporting substrate and an amorphous hydrogenated silicon composition containing from about 25 parts per million by weight to about 1 percent by weight of boron compensated with substantially equal amounts of phosphorous. Furthermore, described in U.S. Pat. No. 4,544,617, entitled Electrophotographic Devices Containing Overcoated Amorphous Silicon Compositions, the disclosure of which is totally incorporated herein by reference, are imaging members comprised of a supporting substrate, an amorphous silicon layer, a trapping layer comprised of doped amorphous silicon, and a top overcoating layer of stoichiometric silicon nitrides. More specifically, there is disclosed in this patent an imaging member comprised of a supporting substrate; a carrier transport layer comprised of uncompensated or undoped amorphous silicon; or amorphous silicon slightly doped with p or n type dopant such as boron or phosphorous; a thin trapping layer comprised of amorphous silicon which is heavily doped with p or n type dopants such as boron or phosphorous; and a top overcoating layer of specific stoichiometric silicon nitride, silicon carbide, or amorphous carbon. However, one disadvantage associated with the aforementioned imaging member is that the trapping layer introduces a dark decay component which reduces the charge acceptance for the imaging member.

Additionally, described in U.S. Pat. No. 4,613,556, entitled Heterogeneous Electrophotograhic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide.

Other representative prior art disclosing amorphous silicon imaging members, including those with overcoatings, are U.S. Pat. Nos. 4,460,669; 4,465,750;

4,394,426; 4,394,425; 4,409,308; 4,414,319; 4,443,529; 4,452,874; 4,452,875; 4,483,911; 4,359,512; 4,403,026; 4,416,962; 4,423,133; 4,460,670; 4,461,820; 4,484,809; and 4,490,453. Additionally, patents that may be of background interest with respect to amorphous silicon photoreceptor members include, for example, U.S. Pat. Nos. 4,359,512; 4,377,628; 4,420,546; 4,471,042; 4,477,549; 4,486,521; and 4,490,454.

Further, additional respresentative prior art patents that disclose amorphous silicon imaging members include, for example, U.S. Pat. No. 4,357,179 directed to methods for preparing imaging members containing high density amorphous silicon or germanium; U.S. Pat. No. 4,237,501 which discloses a method for preparing hydrogenated amorphous silicon wherein ammonia is introduced into a reaction chamber; U.S. Pat. Nos. 4,359,514; 4,404,076; 4,403,026; 4,397,933; 4,423,133; 4,461,819, 4,237,151; 4,356,246; 4,361,638; 4,365,013; 3,160,521; 3,160,522; 3,496,037; 4,394,426; and 3,892,650. Of specific interest are the amorphous silicon photoreceptors illustrated in U.S. Pat. Nos. 4,394,425; 4,394,426 and 4,409,308 wherein overcoatings such as silicon nitride and silicon carbide are selected. Examples of silicon nitride overcoatings include those with a nitrogen content of from about 43 to about 60 atomic percent.

Moreover, the use of silicones and reactive silane coupling agents as overcoatings for photoreceptors, excluding amorphous silicon imaging members, is illustrated in U.S. Pat. Nos. 4,148,637; 4,256,823; 4,371,600, the disclosures of which are totally incorporated herein by reference; and U.S. Pat. Nos. 4,407,920 and 4,439,509, the disclosures of which are totally incorporated herein by reference. Other patents of background interest with respect to amorphous silicon photoreceptors are U.S. Pat. Nos. 4,529,679 and 4,536,459.

With some of the aforementioned hydrogenated amorhous silicon photoconductive members, particularly those containing overcoatings, for example, of silicon nitride and silicon carbide, the resulting members are not free of chemical and environmental stabilities. For example, although these devices may be useful for their intended purposes at certain relative humidities, for example when this humidity exceeds greater than 70 percent,image deletion believed caused by surface conductivity occurs. Although it is not desired to be limited by theory, it is believed that this is caused by corona ions that induce chemical changes on the surface of the silicon nitride or other equivalent overcoatings. Therefore, in the presence of sufficient water molecules, for example greater than 70 percent relative humidity, surface conductivity is enhanced permitting undesirable resolution loss and image deletion. With the imaging members of the present invention, this problem of humidity sensitivity is alleviated. Therefore, there is a need for hydrogenated amorphous silicon photoresponsive imaging members with improved characteristics. Specifically, there is a need for layered hydrogenated silicon imaging members that possess desirable high charge acceptance value, low charge loss characteristics in the dark, and further are insensitive to humidity. Furthermore, there continues to be a need for layered photoresponsive imaging members with a first overcoating layer of silicon nitride or silicon carbide, and thereover an overcoating layer of a silicon or silicone compound thereby enabling the substantial elimination of image deletion at high relative humidities. Furthermore, there is a need for improved layered hydrogenated amorphous silicon imaging members enabling images of increased resolution, no smudging, when compared to similar members containing therein only a single overcoating of a silicon nitride. Additionally, there is a need for improved layered imaging members with a top overcoating layer of a silicon or silicone-silica hybrid component, which members permit photoconductors with humidity insensitivity, and are not adversely effected by electrical consequences resulting from scratching and abrasion. There is also a need for hydrogenated amorphous silicon imaging members which can be selected for use in repetitive imaging and printing systems. Furthermore, there is a need for amorphous silicon imaging members with low surface potential decay rates in the dark, and photosensitivity in the visible and near visible wavelength range. In addition, there is a need for improved layered amorphous silicon imaging members which have very few image defects such as white spots

SUMMARY OF THE INVENTION

It is therefore an object of the present invention to provide photoresponsive imaging members with improved characteristics.

In another object of the present invention there are provided layered imaging members of hydrogenated amorphous silicon which are humidity insensitive.

Also, in another aspect of the present invention there are provided layered photoconductive imaging members with top overcoatings of silicone-silica hybrid components rendering the resulting member insensitive to humidity.

Additionally, in yet another specific object of the present invention there are provided layered photoresponsive imaging members with a first overcoating of nonstoichiometric silicon nitride or silicon carbide and a second top overcoating of a silicone-silica hybrid, which members are substantially insensitive to humidity, including those situations wherein the relative humidity exceeds 70 percent.

Additionally, in yet another specific object of the present invention there are provided layered photoresponsive imaging members with a first overcoating of nonstoichiometric silicon nitride, a second overcoating of stoichiometric silicon nitride, and an overcoating of a silicone-silica hybrid, which members are substantially humidity insensitive.

Also, in another object of the present invention there are provided layered photoconductive imaging members which are substantially insensitive to relative humidities, and which are rendered photosensitive in the near infrared by suitable alloying of the amorphous silicon photoconductive layer with germanium and tin, or compositions derivable from carbon and germanium.

Another object of the present invention resides in the provision of layered hydrogenated amorphous silicon photoresponsive imaging members with overcoatings of silicone-silica hybrid materials wherein images of excellent resolution are obtained, and defects such as white spots are substantially eliminated at relative humidities exceeding 70 percent.

Furthermore, in another object of the present invention there are provided photoresponsive imaging members with hydrogenated amorphous silicon and as a top overcoating a silicone-silica hybrid component, which members are useful in imaging and printing systems at high relative humidities.

In yet a further object of the present invention there are provided photoresponsive imaging members with hydrogenated amorphous silicon, and as a top overcoating a silicone-silica hybrid component which members enable the efficient and substantially complete transfer of the developed image to a supporting substrate such as paper.

These and other objects of the present invention are accomplished by the provision of an overcoated amorphous silicon photoresponsive imaging member. More specifically, in accordance with the present invention there are provided layered photoresponsive imaging members comprised of hydrogenated amorphous silicon, a first overcoating of silicon nitride or silicon carbide, and a second top overcoating of a silicone-silica hybrid as illustrated, for example, in U.S. Pat. No. 4,565,760, entitled Protective Overcoatings for Photoresponsive Imaging Members, the disclosure of which is totally incorporated herein by reference. Accordingly, in one specific embodiment of the present invention there is provided a layered photoresponsive imaging member comprised of a supporting substrate, a barrier layer of hydrogenated amorphous silicon with dopants therein, a photoconductive layer of hydrogenated amorphous silicon with from about 5 to about 40 atomic percent hydrogen and a dopant, a first overcoating layer of silicon nitride or silicon carbide, and thereover a second overcoating layer of a silicone-silica hybrid component. More specifically, in another embodiment of the present invention there is provided a photoresponsive imaging member comprised of a supporting substrate, a barrier layer of hydrogenated amorphous silicon with from about 20 parts per million to about 2,000 parts per million of boron; a photoconductive or bulk layer of hydrogenated amorphous silicon with from about 5 to about 40 atomic percent by weight of hydrogen, and containing therein dopants such as boron or aluminum in an amount of from about 0.5 parts per million to about 10 parts per million; a first overcoating layer of silicon nitride with from about 5 atomic percent of nitrogen to about 33 atomic percent of nitrogen, and from about 95 atomic perent of silicon to about 67 atomic percent of silicon; and thereover a second top overcoating layer of silicone-silica hybrid polymers inclusive of those commercially available from Dow Corning as SRC; from General Electric as SHC-1000, SHC-1010, SHC-1200; from Owens Illinois as glass resins Type 100, 650, 908 and 950; and the like. Other useful materials for the second top overcoating include trimethyl chlorosilane, trimethyl bromosilane, trimethyl silylpiperidine, triphenyl chlorosilane, dimethyl phenyl chlorosilane, and the like. More specifically, one of the silicone-silica hybrid crosslinked polymers referred to herein has been characterized as a dispersion of colloidal silica and a hydroxylated silsequioxane in an alcoholic medium.

The photoresponsive or photoconductive members of the present invention can be incorporated into various imaging apparatuses wherein, for example, latent electrostatic images are formed followed by development, subsequently transferring the developed image to a suitable substrate; and optionally permanently affixing the image thereto. Moreover, the photoconductive imaging members of the present invention, in certain configurations, can be selected for use in xerographic printing processes, that is for example when the member includes therein a component which is sensitive to the infrared region of the spectrum. Also, the photoresponsive imaging members of the present invention can be incorporated into imaging apparatuses wherein there is selected for rendering the images visible a liquid development process. In addition, the photoresponsive imaging members of the present invention, when incorporated into xerograhic imaging processes, possess high charge acceptances of, for example, 40 volts per micron or greater; have very low dark decay characteristics, 100 volts per second; and can be fabricated with the desirable properties in thicknesses of 100 microns or less. Also, the photoconductive members of the present invention enable the generation of images with increased resolution as a result of the elimination of the lateral movement of charge at the interface of the overcoating layer. Furthermore, the imaging membes of the present invention enable the generation of images with substantially no white spots.

Of critical importance with respect to the photoresponsive imaging members of the present invention is the presence of the silicone-silica hybrid second overcoating layer rendering the resulting members humidity insensitive thereby encompassing situations wherein no image deletion or blurring results at relative humidities exceeding 70 percent. Other advantages of the imaging members of the present invention reside in the readily and substantially complete transfer of developed toner images from the imaging member to a supporting substrate such as paper.

Moreover, the photoresponsive members of the present invention can be incorporated into xerographic printing and imaging apparatuses inclusive of those with solid state lasers or electroluminescent light sources as these members can be rendered sufficiently sensitive to wavelengths of up to 7,800 Angstroms when the photoconducting layer is suitably alloyed with germanium or tin; or fabricated from germanium-carbon alloys. Also, the photorsponsive imaging members of the present invention are substantially insensitive to humidity conditions, and corona ions generated from corona charging devices enabling these members to generate acceptable images of high resolution for an extended number of imaging cycles exceeding, in most instances, 500,000.

BRIEF DESCRIPTION OF THE DRAWINGS

For a better understanding of the present invention and further features thereof reference is made to the following description of the preferred embodiments wherein.

Figure 1:
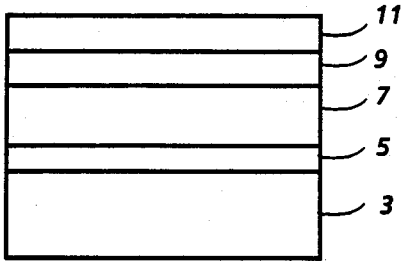
FIG. 1 is a partially schematic cross-sectional view of the photoresponsive imaging member of the present invention.

Illustrated in FIG. 1 is a photoresponsive imaging member of the present invention comprised of a supporting substrate 3, a barrier layer 5 in a thicknes of from about 0.02 to about 1 micron of hydrogenated amorphous silicon with dopants therein; a photoconductive or bulk layer of hydrogenated, with from about 5 to about 40 atomic percent hydrogen, amorphous silicon 7 of a thickness of from about 2 to about 100 microns; a first overcoating layer of nonstoichiometric silicon nitride 9; and a second overcoating layer of a silicone-silica hybrid polymer 11 in a thickness of from about 0.1 to about 4 microns.

Figure 2:
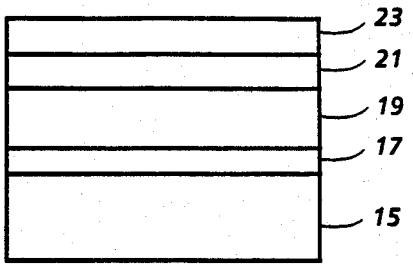
FIG. 2 is a partially schematic cross-sectional view of a further photoresponsive imaging member of the present invention.

Illustrated in FIG. 2 is a further photoresponsive imaging member of the present invention comprised of a supporting substrate 15; a barrier or blocking layer 17 of hydrogenated amorphous silicon with from about 10 to about 40 atomic percent hydrogen, and about 100 parts per million of boron; a photoconductive layer of hydrogenated amorphous silicon 19 containing from about 10 to about 40 atomic percent hydrogen, and about 1 to 3 parts per million of boron, which layer is a thickness of from about 2 microns to about 100 microns; a first overcoating layer 21 of nonstoichiometric silicon nitride in a thickness of about 0.2 micron containing from 95 atomic percent of silicon to about 67 atomic percent of silicon, and from 5 atomic percent of nitrogen to about 33 atomic percent of nitrogen; and thereover a second overcoating 23 of silicone-silica hybrid polymers.

Figure 3:
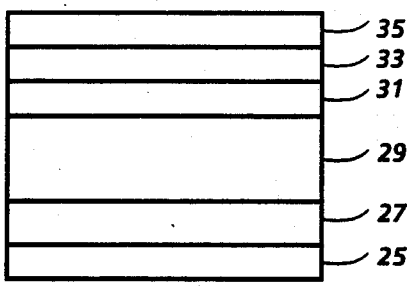
FIG. 3 is a partially schematic cross-sectional view of a further photoresponsive imaging member of the present invention.

Illustrated in FIG. 3 is a further photoresponsive imaging member of the present invention comprised of a supporting substrate 25; a barrier or blocking layer 27 of hydrogenated amorphous silicon with from about 10 to about 40 atomic percent hydrogen, and about 100 parts per million of the dopant boron; a photoconductive layer of hydrogenated amorphous silicon 29 containing from about 10 to about 40 atomic percent hydrogen, and about 1 to 3 parts per million of boron, which layer is of a thickness of from about 2 microns to about 100 microns; a first overcoating layer 31 of nonstoichiometric silicon nitride in a thickness of about 0.2 micron containing 95 atomic percent of silicon to about 67 atomic percent of silicon, and from 5 atomic percent of nitrogen to about 33 atomic percent of nitrogen; and a second overcoating layer 33 of near stoichiometric silicon nitride in a thickness of 0.2 micron containing 67 atomic percent of silicon to about 43 atomic percent of silicon, and from 33 atomic percent of nitrogen to about 57 atomic percent of nitrogen; and a top overcoating layer 35 of a silicone-silica hybrid polymer.

Figure 4:
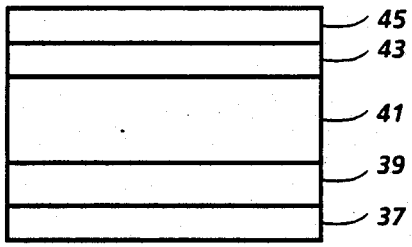
FIG. 4 is a partially schematic cross-sectional view of a further photoresponsive imaging member of the present invention.

Illustrated in FIG. 4 is a further photoresponsive imaging member of the present invention comprised of a supporting substrate 37; a barrier or blocking layer 39 of hydrogenated amorphous silicon with from about 10 to about 40 atomic percent hydrogen and about 100 parts per million of boron; a photoconductive layer of hydrogenated amorphous silcon 41 containing from about 10 to about 40 atomic percent hydrogen and about 1 to 3 parts per million of boron, which layer is of a thickness of from about 2 microns to about 100 microns; a first overcoating layer 43 of silicon carbide in a thickness of about 0.2 micron containing 95 atomic percent of silicon to 50 atomic percent silicon, and from 5 atomic percent carbon to 50 atomic percent carbon; and a top overcoating layer 45 of a silicon-silica hybrid polymer.

Figure 5:
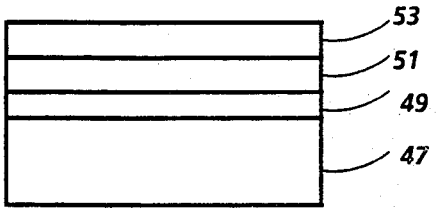
FIG. 5 is a partially schematic cross-sectional view of a prior art photoresponsive imaging member with overcoatings of silicon carbide.

Illustrated in FIG. 5 is a prior art photoresponsive imaging member comprised of a supporting substrate 47; a blocking layer 49 of hydrogenated, with from about 10 to about 40 atomic percent of hydrogen, amorphous silicon with about 100 parts per million of boron; a photoconductive layer of a thickness of from about 2 microns to about 100 microns of hydrogenated amorphous silicon 51 with about 3 parts per million boron; and a top overcoating layer 53 of silicon carbide with 50 atomic percent silicon, and 50 atomic percent carbon. The aforementioned imaging member of FIG. 5 does not possess the improved characteristics of the imaging member of the present invention such as insensitivity to relative humidity, particularly when the relative humidity exceeds 70 percent; and further the imaging member of FIG. 5 results in print deletions at relative humidities exceeding 50 percent, which is not the situation with the imaging members of the present invention as illustrated, for example, in FIGS. 1 to 4. More specifically, for example, the photoresponsive imaging members as illustrated in FIGS. 1 to 5 were incorporated into a Xerox Corporation 3100® imaging apparatus. Initially, images were formulated and developed at a temperature of from between about 60° to about 80° F. and a relative humidity of less than 50 percent. With all imaging members including that of FIG. 5, images of exceptional resolution, that is greater than 6 line pairs per milliliter, were obtained. However, when the aforementioned process was repeated with the exception that the temperature was 75° F. and the relative humidity was 70 percent, there resulted with the imaging member of FIG. 5 images of poor resolution with substantial background deposits together with print deletion areas beginning with the first copy; in comparison, the photoresponsive imaging members of FIGS. 1 to 4 under the same conditions there resulted images of excellent resolution with substantially no background deposits, and which images were free of deletion areas. Although it is not desired to be limited by theory, it is believed that the print deletion effect is caused by changes on either the silicon carbide or silicon nitride surfaces exposed to corona effluence and ions. The aformentioned modifications result in adsorption of water on the surface especially under high relative humidity operating conditions such as relative humidities of 70 percent causing undesirable lateral conductivity. The aforementioned lateral conductivity present on the surface causes image resolution loss and print deletion areas in the resulting developed images subsequent to transfer from the imaging member. In contrast, with the imaging members of the present invention which contain the layers indicated inclusive of the top overcoating of a silicone-silica hard coat there is avoided the chemical changes, and particularly the adsorption of water on the silicon nitride or silicon carbide surfaces. More specifically, the free surfaces of the silicone-silica hardcoat overcoating layer present on the imaging members of the present invention is not effected by relative humidities of 70 percent or greater thereby enabling images of excellent resolution to be obtained beginning with the first imaging cycle, and further permitting the other advantages as mentioned hereinbefore.

Inclusion of other elements such as germanium or tin in the hydrogenated amorphous silicon photoconductive imaging members of the present invention can be accomplished by the simultaneous glow discharge of, for example, silane and germane or stanane. The alloying of silicon with germanium and/or tin is useful as the band gap of the alloy is smaller than that of the hydrogenated photoconductive amorphous silicon layer itself thus permitting photoresponse to longer wavelengths. A thin layer of silicon and germanium can be introduced between the barrier and the photoconductive layer, or between the photoconducting and overcoating layers of FIGS. 1 and 2.

The supporting substrates for each of the imaging members illustrated in the Figures may be opaque or substantially transparent, thus this substrate can be comprised of numerous substances providing the objectives of the present invention are achieved. Specific examples of substrates are insulating materials such as inorganic or organic polymeric compositions; a layer of an organic or inorganic material having a semiconductive surface layer thereon, such as indium tin oxide; or a conductive material such as, for example, aluminum, chromium, nickel, brass, stainless steel, and the like. The substrate may be flexible or rigid with many different configurations such as, for example, a plate, a cylindrical drum, a scroll, an endless flexible belt, and the like. Preferably, the substrate is in the form of a cylindrical drum, or endless flexible belt. In some situations, it may be desirable to coat on the back of the substrate, particularly when the substrate is an organic polymeric material, an anticurl layer such as, for example, polycarbonate materials commercially available as Makrolon®. The substrates are preferably comprised of aluminum, stainless steel sleeve, or an oxidized nickel composition.

Also, the thickness of the substrate layer depends on many factors including economical considerations, and required mechanical properties. Accordingly thus, this layer can be of a thickness of from about 0.01 inch (154 microns) to about 0.2 inch (5,080 microns), and preferably is of a thickness of from about 0.05 inch (1,270 microns) to about 0.15 inch (3,810 microns). In one particularly preferred embodiment, the supporting substrate is comprised of aluminum or oxidized nickel in a thickness of from about 1 mil to about 10 mils.

Blocking or barrier layers of, for example, a thickness of from about 0.01 micron to about 1 micron that may be selected are generally comprised of amorphous silicon having incorporated therein known p, or n dopants inclusive of boron and phosphorous. Specifically thus, for example, for p or i (intrinsic) doping of the layer there is selected a p+type barrier obtained by doping with a heavy concentration of boron; while for n type photoconductive properties, n+type barriers are selected inclusive of those obtained by doping with phosphorous. The aformentioned dopants can be present in various amounts that will enable, for example, the trapping of the minority carriers injected from the substrates, which carriers are of an opposite sign or charge to that used for affecting discharge of the photoresponsive imaging member. Generally, however, from about 50 parts per million to about 500 parts per million of dopant is present in the barrier layer.

Illustrative examples of materials selected for the photoconducting layer are hydrogenated amorphous silicon, preferably with 10 to 40 atomic percent of hydrogen, especially hydrogenated amorphous silicon as described in the copending applications and patents referred to hereinbefore. Also, particularly useful as photoconducting materials is hydrogenated amorphous silicon compensated with boron and phosphorous, reference U.S. Pat. No. 4,634,647, the disclosure of which has been incorporated herein by reference. More specifically, as indicated herein there is disclosed in this copending application an amorphous silicon composition with from about 25 parts per million by weight to about 1 weight percent of boron compensated with from about 25 parts per million by weight to about 1 weight percent of phosphorous. In addition, the photoconducting bulk layer can be comprised of hydrogenated amorphous silicon doped with from about 1 part per million to about 20 parts per million of boron. These dopants permit a reduction in the dark conductivity of the resulting member.

The first overcoating layer of silicon nitride, silicon carbide, or amorphous carbon can be comprised of the components as illustrated in the patents previously referred to herein, and U.S. Pat. No. 4,666,806 entitled Overcoated Amorphous Silicon Imaging Members; and U.S. Pat. No. 4,663,258, entitled Overcoated Amorphous Silicon Imaging Members, the disclosure of which are totally incorporated herein by reference. More specifically, for example, there can be selected as the first overcoating in a thickness of from about 0.1 micron to about 1 micron $SiN_x$ wherein x is a number of from about 0.05 to about 0.33; $SiC_x$ wherein x is a number of from about 0.05 to about 1; and amorphous carbon. Therefore, the aforementioned specific overcoating of silicon nitride, which is nonstoichiometric contains from between 67 to 95 atomic percent of silicon, and from between 33 to 5 atomic percent of nitrogen. Additionally, with further reference to U.S. Pat. No. 4,663,258 there can be included as the first overcoating layer two overcoatings of silicon nitride. The first layer of silicon nitride is comprised of from between 5 to 33 atomic percent of nitrogen, and 95 to 67 atomic percent of silicon, with a second overcoating layer thereover of near stoichiometric silicon nitride with from between 33 to 57 atomic percent of nitrogen, and 67 to 43 atomic percent of silicon. The first overcoating of silicon carbide can have present therein from about 95 to about 50 atomic percent of silicon, and from about 5 to about 50 atomic percent of carbon. These overcoating layers can be prepared by a number of known techniques including plasma depositions of appropriate proportions of gases of silane, ammonia and methane.

With further respect to the imaging members of the present invention, the silicon nitride overcoatings are generally fabricated by the plasma decomposition of a mixture of silane and ammonia, or silane and nitrogen. The silicon carbide overcoatings are fabricated by the plasma deposition of silane and methane, or ethane. In addition, the desired ratio of nitrogen to silicon in the silicon nitride layer is formulated by adjusting the relative flow rates of the silane and ammonia gases selected. Thus, for example, to obtain nonstoichiometric silicon nitride with a nitrogen to silicon ratio of less than 0.5, the flow rate ratio of ammonia to silane gases is less than 1.55. Moreover, to obtain a stoichiometric silicon nitride $Si_3N_4$ the flow rate ratio of ammonia to silane gases is usually substantial, that is in excess of 100.

With further respect to the second overcoating of the silicone-silica hybrid polymers, they are applied to the photoresponsive devices as separate thin coatings in a thickness of from about 0.2 micron to about 1.5 microns, and preferably in a thickness of about 1.0 micron. Generally, these polymers are applied by known methods, inclusive of blade coating, dip of flow coating, or spraying with a suitable solvent, such as alcohols, or solvent mixtures. In some instances, the overcoating layer can be coated by exposing the imaging member to the vapor of the material in a dry atmosphere. The aforementioned silicone-silica hybrid polymers are applied to photoresponsive devices illustrated herein primarily for protection purposes, and for assisting in the release and transfer of toner particles from such devices.

The silicone-silica hybrid hard polymers of the present invention are soluble insolvents, such as alcohols, and thus can be conveniently coated from alcoholic solutions. Further, once the silicone-silica hybrid is crosslinked into its resinous state, it is no longer soluble, thus enabling it to withstand cleaning solutions such as ethanol. Additionally, because of their nature, photoresponsive devices with the silicone-silica polymer coatings of the present invention can be utilized in liquid toner systems. Furthermore, inorganic or organic photoresponsive devices with the silicone-silica hybrid polymers of the present invention are humidity resistant.

Imaging members of the present invention can be prepared in accordance with the processes as described in the patents and applications referred to hereinbefore. More specifically, thus the imaging members of the present invention can be prepared by simultaneously introducing into a reaction chamber a silane gas often in combination with other gases for the purpose of doping or alloying, followed by the introduction of more silane gas and ammonia. In one specific embodiment, the process of preparation involves providing a receptacle containing therein a first substrate electrode means, and a second counterelectrode means providing a cylindrical surface on the first electrode means, heating the cyindrical surface with heating elements contained in the first electrode means while causing the first electrode means to axially rotate, introducing into the reaction vessel a source of silicon and hydrogen containing gas often in combination with other diluting, doping or alloying gases at a right angle with respect to the cylindrical member, applying an rf voltage on the second electrode with the first electrode grounded whereby the silane gas is decomposed resulting in the deposition of hydrogenated amorphous silicon or doped hydrogenated amorphous silicon on the cylindrical member. Thereafter, there is introduced into the reaction chamber further silane gas enabling the formation of the bulk photoconducting layer, followed by the introduction of a mixture of silane gas and ammonia. The atomic percent of silicon and nitrogen in the first overcoating is dependent on the ratio of gases introduced into the chamber. Also, the total flow rates of the gases are maintained at between 50 and 400 sccm, and the pressure inside the vessel is held at a constant 250 to 1,000 milliTorr. In addition, the radio frequency electrical power density rf is between 0.01 and 1 W/cm$^2$ of electrode area, and the substrate temperature during the deposition process can be between 100° and 300° C. Subsequently, there is applied to the silicon nitride overcoating the silicone-silica hybrid polymer of the present invention as detailed herein.

Specifically, therefore, the hydrogenated amorphous silicon photoconducting layer can be deposited by the glow discharge decomposition of a silane gas alone, or decomposition in the presence of small amounts of dopant gases such as diborane and/or phosphine. The range of useful flow rates, radio frequency power levels and reactor pressures are approximately the same as that described in the copending applications and patents referred to herein. Specifically, the rates are 200 sccm of silane, and 6 sccm of 100 parts per million diborane doped silane. The specific pressure is 850 mTorr, and the total rf power is about 100 watts.

This invention will now be described in detail with respect to specific preferred embodiments thereof, it being understood that these examples are intended to be illustrative only. The invention is not intended to be limited to the materials, conditions or process parameters recited herein. All parts and percentages are by weight unless otherwise indicated.

With respect to the examples that follow, unless otherwise indicated the boron doped hydrogenated amorphous silicon and overcoating layers of silicon nitride were fabricated in a stainless steel reactor with the gas composition, pressure, rf power, time of deposition, and other parameters as detailed. Also, there were selected as the supporting substrates aluminum drums with an outer diameter of 85 millimeters, and a length of 400 millimeters. These drums were mounted in a stainless steel vacuum reactor, followed by rotating and heating to a temperature of 210° C. Thereafter, the reactor was evacuated by applying a vacuum thereto, and the appropriate gases were introduced into the stainless steel reaction chamber with flow meters and flow valves. Throttle valves are selected to adjust the pressure. Further, the fabrication was accomplished by rf (13.6 megacycles) plasma decomposition of the gases illustrated. A capacitively coupled configuration was selected by grounding the drum and utilizing a large concentric static electrode as the rf electrode. Subsequent to fabrication of the appropriate layers, argon was passed through the reactor while the supporting substrate drum was being simultaneously cooled. Subsequently, the imaging members were overcoated with a silicone-silica hybrid polymer.

The hydrogenated amorphous silicon photoreceptor members prepared were then tested in a standard scanner for the purpose of determining the photoconductive characteristics thereof. The scanner is an apparatus in which there is provision for mounting and rotating the members or drums along its axis. Charging corotron, exposure, erase lamps, and voltage measuring probes are mounted along the circumference. Specifically, the testing was affected by permitting the scanner to operate at a surface speed of 20 revolutions per minute, and subjecting the member to a positive polarity of 7,000 volts corona potential with a 10 centimeters long corotron. Thereafter, the dark decay and the light induced decay of the potentials were measured by a series of electrical probes mounted along the circumference of the photoreceptor. The scanner results indicate the charging capabilities of the photoreceptor structure, that is, dark decay values; and the discharge characteristics of the photoreceptor when subjected to light illumination. Additionally, each of the photoresponsive imaging members prepared were print tested in a Xerox Corporation 3100® apparatus as specified at ambient humidities of less than 50 percent, and in an environmental chamber maintained at the relative humidities indicated.

EXAMPLE I

A three layered hydrogenated amorphous silicon photoreceptor was fabricated on a 5 mil thick aluminum drum with a length of 400 millimeters and a diameter of 85 millimeters by introducing into a reaction chamber 200 sccm of silane gas doped with 100 parts per million of diborane. The throttle on the pumping system was adjusted to obtain a plasma pressure of 375 microns in the reaction vessel while the rf power was maintained at 160 watts. Initially, a barrier or first layer was deposited on the aluminum drum after 5 minutes, which layer consisted of hydrogenated, about 250 atomic percent of hydrogen, amorphous silicon doped with 100 parts per million of boron, and was a thickness of 500 Angstroms.

Subsequently, a second photoconductive bulk layer was applied to the barrier layer by introducing into the reaction chamber 200 sccm of silane gas and 6 sccm of silane gas doped with 100 parts per million of diborane. The plasma pressure in the chamber was maintained at 800 microns, the rf power was 100 watts, and the deposition time was 180 minutes. There resulted in a thickness of 17 microns a bulk layer consisting of hydrogenated, about 25 atomic percent of hydrogen, amorphous silicon doped with 3 parts per million of boron.

Thereafter, there was applied to the bulk layer an overcoating of nonstoichiometric silicon nitride by introducing 86 sccm of silane gas and 114 sccm of ammonia. The throttle was adjusted to obtain a plasma pressure of 300 microns with an rf power of 40 watts, and a plasma deposition time of 4 minutes. There resulted an overcoating layer in a thickness 0.05 micron of silicon nitride containing a nitrogen to silicon atomic ratio of 0.45.

Subsequently, one half of the above prepared hydrogenated amorphous silicon imaging member was overcoated with a coating solution comprised of 72.0 grams of a Dow Corning silicon hardcoat available as X2-7358 with 20 percent solids, 164.0 grams of methyl alcohol, 163.5 grams of isobutanol, and 0.5 grams of gamma amino propyl thiethoxy silane, available from Union Carbide as A-1100. More specifically, the prepared overcoated hydrogenated amorphous silicon imaging member was situated on a horizontal mandrel present in a spray booth. One half of the imaging member surface area was masked thereby permitting a second half exposed surface area that was coated with the above coating solution. The spraying of the solution is controlled to enable the formation of a silicon hard top overcoating layer with a dry thickness of from about 0.1 to 1 micron. The resulting imaging member was then air dried, and placed in a forced air oven where the temperature was maintained at 80° C. for one hour for the purpose of permitting crosslinking of the silicon hardcoat layer.

Each half of the aforementioned prepared imaging member was then tested in the scanner illustrated herein, and there resulted a charge acceptance on both halves of 525 volts, a dark decay of 100 volts/scc. The light intensity required to discharge both halves was 20 ergs/cm$^2$.

This imaging member was then print tested at 50 percent relative humidity (RH) at 75° F. in the Xerox Corporation 3100® apparatus. Images of resolution exceeding 6 line pairs per millimeter were obtained on both halves of the member.

Subsequently, the imaging member was then print tested at 80 percent relative humidity at 80° F. in the Xerox Corporation 3100® apparatus, and there resulted on the half of the imaging member with no silicon hardcoat overcoating images with poor resolution, that is less than 6 line pairs per millimeter, which resolution decreased as subsequent images were formed; and at 100 imaging cycles no developed images were observed in certain regions of the imaging member half without the overcoated silicon hardcoat. In contrast, the half of the imaging member containing the silicon hardcoat overcoat enabled developed images of superior resolution, that is exceeding 6 line pair per millimeter, beginning with the first copy and continuing on to 100 imaging cycles at an RH of 80 percent and a temperature of 80° F. in the 3100®.

EXAMPLE II

A photoresponsive imaging member was prepared by repeating the procedure of Example I with the exception that there was applied below the silicon hardcoat layer a primer applied by spraying and formulated from a solution, 80/20 percent by weight (0.1 weight percent of solids) of PE-200 polyester available from Goodyear Chemical Corporation, and polymethylmethacrylate available from Polysciences Inc. in a 50/50 percent by weight blend of methylene chloride and 1,1,2-trichloroethane.

When the aforementioned imaging member was tested in the scanner, and images developed in the Xerox Corporation 3100® apparatus by repeating the procedure of Example I, substantially similar results were obtained, that is for example at 50 percent relative humidity and 75° F., prints of acceptable resolution, better than 6 line pairs per millimeter, were obtained on both halves of the imaging member. In contrast, at 80 percent relative humidity and 80° F., the half of the imaging member without the silicon hardcoating generated images of poor resolution, that is less than 6 line pairs per millimeter, which resolution continually decreased until at 100 imaging cycles substantially no developed images were observed on certain regions of this half of the photoreceptor member. With respect to the half of the imaging member that contained the silicon hard overcoating, the resolution exceeded 6 line pairs per millimeter beginning with the first imaging cycle and continuing on to 100 imaging cycles at 80 percent RH and 80° F.

EXAMPLE III

An imaging member was prepared by repeating the procedure of Example I with the exception that half of the imaging member was overcoated with the silane hardcoat obtained from a coating solution comprised of 72.0 grams of the Dow Corning silicon hardcoat, 164.0 grams of methyl alcohol, 160.0 grams of isobutanol, 3.5 grams of hydrolyzed $(CH_3O)_3\ Si(CH_2)_3\ N+(CH_3)_3\ Cl-$(20 percent in methyl alcohol/water), and 0.5 gram of the A-1100.

Subsequently, both halves, one with the silicon hardcoat and one without the silicon hardcoat, of the resulting imaging member were tested in a scanner and images were formulated in the 3100® by repeating the procedure of Example I, and substantially similar results were obtained.

EXAMPLE IV

An imaging member was prepared by repeating the procedure of Example III with the exception that there was further incorporated into the imaging member a primer layer formulated from the solution illustrated in Example II, and comprised of 80/20 percent by weight (0.1 weight percent of solids) of PE-200 polyester and polymethylmethacrylate in a 50/50 percent by weight blend of methylene chloride and 1,1,2-trichloroethane.

Subsequently, both halves of the resulting imaging member were tested in a scanner and images were formulated in the Xerox Corporation 3100® by repeating the procedure of Example III, and substantially similar results were obtained.

EXAMPLE V

An imaging member was prepared by repeating the procedure of Example I with the exception that as the top overcoating there was selected a nonstoichiometric silicon nitride which has been exposed to N,N-dimethylamino trimethyl silane vapor introduced with a nitrogen gas stream for a sufficient period of time to permit reaction of the silane monomer with any active hydrogen sites on the surface of the overcoat thereby rendering such sites hydrophobic, and improving the electrical performance of the resulting imaging member at a humidity exceeding 75 percent.

Subsequently, both halves of the resulting member were tested in a scanner and images were formulated in the Xerox Corporation 3100® by repeating the procedure of Example IV, and substantially similar results were obtained.

EXAMPLE VI

A four layered photoresponsive imaging member was prepared by repeating the procedure of Example I with the exception that there was formulated as another layer located below and in contact with the top silicon hardcoating layer a near stoichiometric silicone nitride layer fabricated by introducing into the reaction chamber 25 sccm of silane and 200 sccm of ammonia. The plasma pressure was 380 microns and the rf power was 40 watts.

The resulting imaging member, both halves, was then tested in a scanner and images were formulated in the Xerox Corporation 3100® by repeating the procedure of Example I, and substantially similar results were obtained.

EXAMPLE VII

A four layered photoresponsive imaging member was prepared by repeating the procedure of Example II with the exception that there was formulated as another layer located below and in contact with the silicon hard overcoating a layer comprised of a near stoichiometric silicon nitride fabricated by introducing into the reaction chamber 25 sccm of silane and 200 sccm of ammonia. The plasma pressure was 380 microns, the rf power was 40 watts, and the fabrication of this layer was completed in 4 minutes.

Subsequently, both halves of the resulting imaging member were tested in a scanner and images were formulated in the Xerox Corporation 3100® by repeating the procedure of Example II, and substantially similar results were obtained.

EXAMPLE VIII

A four layered photoresponsive imaging member was prepared by repeating the procedure of Example III with the exception that there was formulated an additional layer located below and in contact with the silicon hardcoating, which layer was comprised of near stoichiometric silicon nitride fabricated by introducing into the reaction chamber 25 sccm of silane and 200 sccm of ammonia. The plasma pressure was 380 microns, the rf power was 40 watts, and the fabrication of this layer was completed in 4 minutes.

The resulting imaging member, both halves, was then tested in a scanner and images were formulated in the Xerox Corporation 3100® by repeating the procedure of Example III, and substantially similar results were obtained.

EXAMPLE IX

A four layered photoresponsive imaging member was prepared by repeating the procedure of Example IV with the exception that there was included therein a further layer located below and in contact with silicon hard overcoating, which layer was comprised of a near stoichiometric silicon nitride overcoating fabricated by introducing into the reaction chamber 25 sccm of silane and 200 sccm of ammonia. The plasma pressure was 380 microns, the rf power was 40 watts, and the fabrication of this layer was completed in 4 minutes.

Subsequently, both halves of the resulting imaging member were tested in a scanner and images were formulated in the Xerox Corporation 3100® by repeating the procedures of Example IV, and substantially similar results were obtained.

EXAMPLE X

A four layered photoresponsive imaging member was prepared by repeating the procedure of Example V with the exception that there was further included in the member an additional layer located below and in contact with the silicon hard overcoating, which layer was comprised of a near stoichiometric silicon nitride overcoating fabricated by introducing into the reaction chamber 25 sccm of silane and 200 sccm of ammonia. The plasma pressure was 380 microns, the rf power was 40 watts, and the fabrication of this layer was completed in 4 minutes.

Thereafter, both halves of the resulting imaging member were tested in a scanner and images were formulated in the Xerox Corporation 3100® by repeating the procedures of Example V, and substantially similar results were obtained.

EXAMPLE XI

A three layered photoresponsive imaging member was prepared by repeating the procedure of Example I with the exception that there was fabricated on an aluminum drum with a length of 400 millimeters and a diameter of 85 millimeters a barrier layer by flowing 50 sccm of silane containing 1 percent diborane and 150 sccm of ammonia into a reaction chamber. The plasma pressure was maintained at 550 microns and the rf powder selected was 50 watts. In addition, the deposition time was about 10 minutes.

There resulted a barrier layer of boron doped silicon nitride containing a nitrogen to silicon ratio of 0.75. Additionally, the second or bulk photoconductive layer applied to the barrier layer was formulated by introducing into the reaction chamber 200 sccm of silane gas and 35 sccm of silane gas doped with 100 parts per million of diborane. The plasma pressure in the chamber was maintained at 850 microns, the rf power was 100 watts, and the deposition time was 240 minutes. There resulted a bulk layer of a thickness of 24 microns containing hydrogenated, about 25 atomic percent of hydrogen, amorphous silicon doped with 1.5 parts per million of a boron. A third layer of nonstoichiometric silicon nitride, and the subsequent deposition of the silicone hardcoat on half the member was then accomplished in accordance with the process of Example I.

Subsequently, both halves of the resulting imaging member were tested in a scanner and images were formulated in the Xerox Corporation 3100® by repeating the procedures of Example 1, and similar results were obtained. More specifically, with respect to the scanner results there resulted a charge acceptance on both halves of the photoreceptor of 800 volts, a dark decay of 160 volts/second, and the light intensity required to discharge both sides remained at 20 ergs/cm$^2$. The imaging results on both halves of the imaging member subsequent to use in the Xerox Corporation 3100® imaging apparatus at 50 percent relative humidity and 75° F., and at 80 percent relative humidity and 80° F. were as reported in Example I.

EXAMPLE XII

A three layered photoresponsive imaging member was prepared by repeating the procedure of Example II with the exception that there was selected as the barrier layer and the bulk layer the layers as formulated in accordance with the procedure of Example XI. More specifically, the barrier layer consisted of a boron doped silicon nitride containing a nitrogen to silicon ratio of 0.75, and the bulk or second layer consisted of hydrogenated amorphous silicon with about 25 atomic percent of hydrogen doped with 1.5 parts per million of boron.

Subsequently, both halves of the resulting imaging member were tested in a scanner and images were formulated in the Xerox Corporation 3100® by repeating the procedures of Example XI, and substantially similar results were obtained.

EXAMPLE XIII

A three layered photoresponsive imaging member was prepared by repeating the procedure of Example III with the exception that the barrier layer and the bulk layers were formulated in accordance with the procedure of Example XI. More specifically, the barrier layer consisted of a boron doped silicon nitride containing a nitrogen to silicon ratio of 0.75, and the bulk or second layer consisted of hydrogenated, 25 atomic percent of hydrogen, amorphous silicon doped with 1.5 parts per million of boron.

Subsequently, both halves of the resultng imaging member were tested in a scanner and images were formulated in the Xerox Corporation 3100® by repeating the procedures of Example XI, and substantially similar results were obtained.

EXAMPLE XIV

A three layered photoresponsive imaging member was prepared by repeating the procedure of Example IV with the exception that the barrier layer and the bulk layer were formulated in accordance with the procedure of Example XI. More specifically, the barrier layer consisted of a boron doped silicon nitride containing a nitrogen to silicon ratio of 0.75, and the bulk layer contained hyrogenated, 25 atomic percent of hydrogen, amorphous silicon doped with 1.5 parts per million of boron.

Subsequently, both halves of the resulting imaging member were tested in a scanner and images were formulated in the Xerox Corporation 3100® by repeating the procedure of Example XI, and substantially similar results were obtained.

EXAMPLE XV

A three layered photoresponsive imaging member was prepared by repeating the procedure of Example V with the exception that there was selected as the barrier layer and the bulk layer, the layers as formulated in accordance with the procedure of Example XI. More specifically, the barrier layer consisted of silicon nitride containing a nitrogen to silicon ratio of 0.75, and the bulk layer consisted of hydrogenated, 25 atomic percent of hydrogen, amorphous silicon doped with 1.5 parts per million of boron.

Subsequently, both halves of the resulting imaging member were tested in a scanner and images were formulated in the Xerox Corporation 3100® by repeating the procedure of Example XI, and substantially similar results were obtained.

EXAMPLE XVI

A three layered photoresponsive imaging member was prepared by repeating the procedure of Example XI with the exception that there was selected for application to the bulk photoconductive layer as an overcoating in place of the silicon nitride overcoating, silicon carbide by introducing in the reaction chamber 86 sccm of silane gas and 114 sccm of methane and wherein the plasma pressure in the reaction chamber was maintained at 550 microns, the rf power was set at 50 watts, and the deposition was completed in 10 minutes. There resulted an overcoating layer of silicon carbide in contact with and below the silicon hardcoat overcoating layer.

Subsequently, both halves of the resulting imaging member were tested in a scanner and images were formulated in the Xerox Corporation 3100® by repeating the procedure of Example I, and substantially similar results were obtained.

EXAMPLE XVII

A three layered photoresponsive imaging member was prepared by repeating the procedure of Example XII with the exception that there was applied to the bulk layer in place of the silicon nitride overcoating, silicon carbide overcoating by introducing in the reaction chamber 86 sccm of silane gas and 114 sccm of methane. The plasma pressure in the reaction chamber was maintained at 550 microns, the rf power was set at 50 watts, and the deposition was completed in 10 minutes. There resulted an overcoating layer of silicon carbide below and in contact with the top silicon hardcoating layers.

Subsequently, both halves of the imaging member prepared were tested in a scanner and images were formulated in the Xerox Corporation 3100® by repeating the procedure of Example I, and substantially similar results were obtained.

EXAMPLE XVIII

A three layered photoresponsive imaging member was prepared by repeating the procedure of Example XIII with the exception that there was applied to the bulk layer in place of the silicon nitride overcoating, silicon carbide by introducing in the reaction chamber 86 sccm of silane gas and 114 sccm of methane; and wherein the plasma pressure in the reaction chamber was maintained at 550 microns, the rf power was set at 50 watts, and the deposition was completed in 10 minutes. There resulted in contact with and below the silicon hard overcoating a silicon carbide layer.

Subsequently, both halves of the imaging member prepared were tested in a scanner and images were formulated in the Xerox Corporation 3100® by repeating the procedures of Example I, and substantially similar results were obtained.

EXAMPLE XIX

A photoresponsive imaging member was prepared by repeating the procedure of Example XIV with the exception that there was applied to the bulk photoconductive layer in place of the silicon nitride overcoating, silicon carbide by introducing in the reaction chamber 86 sccm of silane gas and 114 sccm of methane. The plasma pressure in the reaction chamber was maintained at 550 microns, and the rf power was set at 50 watts. The deposition was completed in 10 minutes. There resulted a silicon carbide overcoating layer in contact with and below the silicon hardcoating layer.

Subsequently, both halves of the imaging member prepared were tested in a scanner and images were formulated in the Xerox Corporation 3100® by repeating the procedures of Example I, and substantially similar results were obtained.

EXAMPLE XX

A three layered photoresponsive imaging member was prepared by repeating the procedure of Example XV with the exception that there was applied to the bulk layer in place of the silicon nitride overcoating, silicon carbide by introducing in the reaction chamber 86 sccm of silane gas and 114 sccm of methane, and wherein the plasma pressure in the reaction chamber was maintained at 550 microns, the rf power was set at 50 watts, and the deposition was completed in 10 minutes. There resulted a silicon carbide overcoating layer in contact with and below the silicon hardcoating layer.

Subsequently, both halves of the imaging member prepared were tested in a scanner and images were formulated in the Xerox Corporation 3100® by repeating the procedures of Example I, and substantially similar results were obtained.

Other modifications of the present invention will occur to those skilled in the art based upon a reading of the present disclosure. These are intended to be included within the scope of this invention.

What is claimed is:

1. A photoresponsive imaging member comprised of a supporting substrate; a barrier layer of hydrogenated amorphous silicon with dopants therein; a photoconductive layer of hydrogenated amorphous silicon; a first overcoating layer of nonstoichiometric silicon nitride; and a second overcoating layer of a silicone-silica hybrid polymer.

2. A photoresponsive imaging member in accordance with claim 1 wherein the second overcoating is comprised of a dispersion of colloidal silica and a hydroxylated silsequixone in an alcoholic medium.

3. A photoresponsive imaging member in accordance with claim 1 wherein the barrier layer contains as dopants therein components selected from the group consisting of boron and aluminum.

4. An imaging member in accordance with claim 3 wherein the dopant is present in an amount of from about 50 parts per million to about 500 parts per million.

5. An imaging member in accordance with claim 1 wherein the amorphous silicon photoconducting layer contains dopants therein.

6. An imaging member in accordance with claim 5 wherein the dopant is boron present in an amount of from about 1 part per million to about 20 parts per million.

7. An imaging member in accordance with claim 1 wherein the photoconducting layer is comprised of amorphous silicon simultaneously doped with boron and phosphorous in an amount of from about 2 parts per million to about 100 parts per million.

8. An imaging member in accordance with claim 1 wherein the photoconducting layer is comprised of an amorphous silicon-germanium alloy.

9. An imaging member in accordance with claim 1 wherein the photoconducting layer is comprised of an amorphous silicon-tin alloy.

10. An imaging member in accordance with claim 1 wherein the photoconducting layer is comprised of an amorphous carbon-germanium alloy.

11. An imaging member in accordance with claim 1 wherein the substrate is comprised of aluminum.

12. An imaging member in accordance with claim 1 wherein the substrate is a flexible belt.

13. An imaging member in accordance with claim 1 wherein the thickness of the photoconducting layer is from about 2 microns to about 100 microns.

14. An imaging member in accordance with claim 1 wherein the first overcoating layer of nonstoichiometric silicon nitride contains from between about 95 atomic percent of silicon to about 67 atomic percent of silicon, and from about 5 atomic percent to about 33 atomic percent nitrogen.

15. An imaging member in accordance with claim 1 wherein a second near stoichiometric silicon nitride is further included between the first nonstoichiometric silicon nitride and the overcoating layer of the silicone-silica hybrid polymer.

16. An imaging member in accordance with claim 15 wherein the near stoichiometric layer contains from about 67 to about 43 atomic percent silicon, and about 33 to about 57 atomic percent nitrogen.

17. An imaging member in accordance with claim 1 wherein the thickness of the supporting substrate is from about 154 microns to about 5,080 microns, the thickness of the photoconductive layer is from about 2 microns to about 100 microns, the thickness of the barrier layer is from about 0.1 micron to about 2 microns, the thickness of the silicon nitride layer is from about 0.05 micron to about 2 microns, and the thickness of the silicone-silica hybrid layer is from about 0.1 micron to about 2 microns.

18. A photoresponsive imaging member comprised of a supporting substrate; a barrier layer of hydrogenated amorphous silicon with dopants therein; a photoconductive layer of hydrogenated amorphous silicon; a first overcoating layer of silicon carbide; and a second overcoating layer of a silicone-silica hybrid polymer.

19. An imaging member in accordance with claim 18 wherein the silicon carbide contains from about 95 to about 50 atomic percent of silicon, and from about 5 to about 50 atomic percent of carbon.

20. A method of imaging which comprises formulating an image on the photoresponsive imaging member of claim 1, subsequently accomplishing development of this image, thereafter transferring the image to a suitable substrate, and optionally permanently affixing the image thereto.

21. A method of imaging in accordance with claim 20 wherein the photoconducting layer of the hydrogenated amorphous silicon member contains dopants therein.

22. A method of imaging in accordance with claim 20 wherein the photoconducting layer of the imaging member is comprised of amorphous silicon doped with boron, or simultaneously with boron and phosphorous in an amount of from about 2 parts per million to about 100 parts per million.

23. A method of imaging in accordance with claim 20 wherein the photoconducting layer of the imaging member is comprised of an amorphous silicon-germanium alloy.

24. A method of imaging in accordance with claim 20 wherein the photoconducting layer of the imaging member is comprised of a silicon-tin alloy.

25. A method of imaging in accordance with claim 20 wherein the photoconducting layer of the imaging member is comprised of an amorphous carbon-germanium alloy.

26. A method of imaging in accordance with claim 20 wherein the thickness of the photoconducting layer of the imaging member is from about 2 microns to about 100 microns.

27. A method of imaging in accordance with claim 20 wherein the thickness of the overcoating layer of the imaging member is from about 0.05 micron to about 2.0 microns.

28. A method of imaging in accordance with claim 20 wherein the barrier layer of the imaging member is doped with boron.

29. A method of imaging in accordance with claim 28 wherein dopants in the barrier layer are present in an amount of from about 50 parts per million to about 500 parts per million.

30. A method of imaging in accordance with claim 20 wherein the substrate of the imaging member is comprised of aluminum.

31. A photoresponsive imaging member in accordance with claim 1 wherein the second overcoating is comprised of a silane coupling component.

32. A photoresponsive imaging member in accordance with claim 31 wherein the second overcoating is comprised of a component selected from the group consisting of trimethylchloro silane, trimethylbromo silane, trimethyl dimethylamino silane, and triethyl dimethylamino silane.

33. A method of imaging in accordance with claim 20 wherein the substrate of the imaging member is a flexible belt.

34. A method of imaging in accordance with claim 20 wherein there results images of excellent resolution at relative humidities of from between about 20 and about 90 percent.

35. A method of imaging in accordance with claim 20 wherein there results images of excellent resolution at relative humidities in excess of 70 percent.

36. A photoresponsive imaging member in accordance with claim 1 wherein said imaging member enables the formation of images of excellent resolution at relative humidities in excess of about 70 percent.

37. A photoresponsive imaging member in accordance with claim 18 wherein said imaging member enables the formation of images of excellent resolution at relative humidities in excess of about 70 percent.

38. A photoresponsive imaging member in accordance with claim 1 wherein said imaging member enables the formation of images of excellent resolution at a relative humidity of 80 percent.

39. A photoresponsive imaging member in accordance with claim 18 wherein said imaging member enables the formation of images of excellent resolution at a relative humidity of 80 percent.

40. A method of imaging in accordance with claim 20 wherein there results images of excellent resolution at a relative humidity of 80 percent.

* * * * *